US009022799B2

(12) United States Patent
Sorolla Rosario et al.

(10) Patent No.: US 9,022,799 B2
(45) Date of Patent: May 5, 2015

(54) COAXIAL RADIOFREQUENCY CONNECTOR

(76) Inventors: Edén Sorolla Rosario, San Vicente del Raspeig (ES); Michael Mattes, Chavannes-près-Renens (CH); Daniel Schonherr, Darmstadt (DE); David Raboso Garcia-Baquero, Madrid (ES); Josef Fuchs, Appenzell (CH); Holger Karstensen, Rorschach (CH)

( * ) Notice: Subject to any disclaimer, the term of this patent is extended or adjusted under 35 U.S.C. 154(b) by 179 days.

(21) Appl. No.: 13/698,023

(22) PCT Filed: May 5, 2011

(86) PCT No.: PCT/EP2011/057242

§ 371 (c)(1), (2), (4) Date: Jan. 28, 2013

(87) PCT Pub. No.: WO2011/141353

PCT Pub. Date: Nov. 17, 2011

(65) Prior Publication Data

US 2013/0143430 A1 Jun. 6, 2013

(30) Foreign Application Priority Data

May 14, 2010 (DE) ..... 20 2010 006 813 U

(51) Int. Cl.

| | |
|---|---|
| ***H01R 13/00*** | (2006.01) |
| ***H01R 13/533*** | (2006.01) |
| ***H01R 24/40*** | (2011.01) |
| ***H01R 9/05*** | (2006.01) |
| *H01R 103/00* | (2006.01) |

(52) U.S. Cl.

CPC ..... *H01R 13/00* (2013.01); *H01R 13/005* (2013.01); *H01R 13/533* (2013.01); *H01R 24/40* (2013.01); *H01R 2103/00* (2013.01); *H01R 9/05* (2013.01)

(58) Field of Classification Search

CPC ..... H01R 13/00; H01R 24/40; H01R 13/33; H01R 9/05; H01L 23/4006

USPC ..... 439/485, 578, 191

See application file for complete search history.

(56) References Cited

U.S. PATENT DOCUMENTS

| | | | | |
|---|---|---|---|---|
| 4,700,743 | A | 10/1987 | L'Henaff et al. | |
| 5,074,802 | A | 12/1991 | Gratziani et al. | |
| 5,637,006 | A * | 6/1997 | Almeras | 439/191 |

FOREIGN PATENT DOCUMENTS

| | | | |
|---|---|---|---|
| CN | 101651270 | A | 2/2010 |
| DE | 39 36 928 | A1 | 5/1991 |
| DE | 199 16 984 | C1 | 7/2000 |
| DE | 10 2004 033 567 | A1 | 1/2006 |
| WO | WO 2011141353 | A1 * | 11/2011 |

* cited by examiner

*Primary Examiner* — Hae Moon Hyeon

(74) *Attorney, Agent, or Firm* — Pauley Petersen & Erickson

(57) ABSTRACT

The invention relates to a coaxial connector with a female and a male connector part. The two connector parts each have an inner ventilation channel which extends in the longitudinal direction of the connector and which opens out into at least one outwardly extending, stepped (when viewed in the longitudinal section) ventilation channel.

9 Claims, 3 Drawing Sheets

COAXIAL RADIOFREQUENCY CONNECTOR

BACKGROUND OF THE INVENTION

1. Field of the Invention

The present invention relates to the field of coaxial radiofrequency connectors or "RF connectors".

2. Discussion of Related Art

Coaxial radiofrequency connectors are indispensable for the transmission of radiofrequency signals and are commonly used for the connection of two devices, e.g. the connection of an aerial to a coaxial cable. Printed circuits are ubiquitous in the area of RF front ends of modern communication systems. With the introduction of semiconductor amplifiers ("solid state power amplifiers" or "SSPAs"), circuits of this type have also become an attractive option for the on-board high-power transmitters of satellites. Previously, this function was fulfilled by traveling wave tube amplifiers or "TWTAs", which also required the use of conventional and cumbersome waveguide technology. One option for the provision of such circuits involves the use of coaxial cables and coaxial connectors. To date, the use of Threaded Neill-Concelman connectors or "TNC connectors" has been necessary, as the smaller SMA connectors (sub-miniature A connectors) were not suitable for the high-power transmission involved. The use of SMA connectors had previously been restricted to the low-voltage range. It would nevertheless be useful if SMA connectors for higher power ratings designed for use in space flight could be used, as these connectors are lighter and smaller. There is a disadvantage, however, in that the internal structure of the present design of conventional SMA connectors imposes substantial restrictions upon the maximum possible transmission capacities. For this reason, TNC connectors are still used today, on the grounds of safety, for transmission capacities of more than a few watts. The higher weight and the larger dimensions of these connectors must be tolerated accordingly.

SMA plug connectors are primarily used for applications in the frequency range of 1 GHz-26.5 GHz. Embodiments up to 40 GHZ are known. Male connectors are generally configured with a screwed union nut, while female connectors are provided with an external thread, namely a pin or sleeve which is arranged to slide over the pin, regardless of the configuration of the inner conductor. The connector parts are described as the SMA male connector and SMA female connector respectively. In comparison with other radiofrequency plug connectors, SMA connectors are relatively small. Currently available SMA connectors are high-precision connectors for microwave applications, and are distinguished by their high mechanical strength, long service life, operational reliability and low Voltage Standing Wave Ratio or "VSWR".

SUMMARY OF THE INVENTION

One object of the present invention is the disclosure of an improved SMA connector, which is suitable for use in space travel and which avoids the disadvantages of connectors which are known from the prior art.

This object is fulfilled by the characteristics of the independent patent claim.

In one form of embodiment, the connector according to the invention is comprised of a screwed connector with a first (male) connector part and a second (female) connector part. The first and second connector parts may be mechanically connected by means of a union nut. The union nut is generally arranged on the male connector part. The connector according to the invention, which is also described as a PSM (power sub-miniature) connector, is not directly compatible with conventional SMA connectors. Although of approximately equivalent outer dimensions and weight, the connectors are of a different internal design, which permits the transmission of significantly higher powers. If required, however, conventional SMA connectors and PSM connectors according to the invention may be operatively connected by means of an adaptor. Although the interior of PSM connectors according to the invention is substantially "gapless", these connectors are designed to permit ventilation in extraterrestrial applications. Conventional SMA connectors are provided with an arrangement of radial gaps which, although detrimental in extraterrestrial application, are of no significance in conventional terrestrial applications.

The connector parts of the PSM connectors according to the invention generally have a sleeve-shaped housing, which is arranged on the exterior and which constitutes an outer conductor. The interior of the housing accommodates an insulator, which is e.g. pressed into the housing, or is otherwise fixed in the latter. The insulator is provided with a central opening for the accommodation of a pin-shaped contact element (contact), which serves as the inner conductor. The pin-shaped contact element is also pressed into the insulator, and is supported on the latter via a shoulder. Other configurations and means of attachment are possible.

Amongst other factors, the restriction of the transmission capacity of SMA connectors is attributable to the inadequate arrangement and configuration of gaps in the interior of the connector parts and between the latter. By the configuration of the interior of the connector according to the invention, the transmission capability of a connector of equal dimensions can be substantially increased. Alternatively, the same transmission capacity can be delivered by a connector of smaller dimensions, in comparison with conventional connectors. In extraterrestrial application, the problem of the unfavorable arrangement of gaps in conventional connectors is exacerbated by the fact that, owing to the prevailing vacuum, the air contained in the gaps is no longer present, or will escape in an uncontrolled manner. Potential problems include the "multipactor phenomenon" or corona discharge, which may also occur in other hollow conductors. The unfavorable arrangement of gaps also has a negative impact upon load capability and heat exchange capability.

In the interests of adequate heat dissipation, a dielectric of adequate thermal conductivity must be used. Polytetrafluoroethylene or "PTFE", for example, has a thermal conductivity of 0.25 W/mK. Another factor to be considered is the electric strength of the dielectric. In the case of PTFE, the puncture voltage ranges from 40 to 80 kV/mm.

The ventilation openings represent a critical area in terms of requirements for the electromagnetic compatibility of a connector (EMC requirements). In one form of embodiment, a total of three ventilation openings are provided, the arrangement and configuration of which is such that the radiofrequency losses have no negative effects. The two connector parts are each provided with one ventilation opening. A further ventilation opening is arranged in the union nut, in the contact zone of the two connector parts. The connector parts may be provided with internal channels for the purposes of controlled ventilation. In one form of embodiment, the contact pin is provided with a channel, at least part of which extends longitudinally, and which is used for controlled ventilation. The longitudinal channel in each connector part is operatively connected to an associated ventilation opening by means of a labyrinthine channel which extends outwardly. Channels extending directly radially to the exterior are generally avoided.

The mechanically- and/or electrically-loaded connector parts are preferably manufactured from one of the following metals: beryllium copper, stainless steel, bronze, titanium. Connector parts are preferably coated with one of the following coating materials: gold, nickel phosphorous coating with a gold flash (Sucopro™), copper-tin-zinc alloy (Sucoplate™).

In one form of embodiment, the invention relates to a coaxial connector with a female and a male connector part, each of which is provided with an inner ventilation channel which extends in the longitudinal direction of the connector and which discharges into at least one outwardly extending ventilation channel, which is stepped when viewed in longitudinal section. Depending upon the form of embodiment, both the female and the male connector parts are provided with an outwardly extending ventilation channel. In one form of embodiment, at least one longitudinal ventilation channel is arranged in the interior of a contact (inner conductor of the connector parts). The stepped ventilation channel may be formed by an insulator of a connector part and an insulator of a cable. In the operatively connected state, an essentially diagonal ventilation channel, viewed in longitudinal section, may be formed between the connector parts. The diagonal ventilation channel may be formed by the insulators of the connector parts. In general, the ventilation channels are configured with a rotationally symmetrical form. Toward the outside, the at least one ventilation channel generally discharges into a ventilation opening. In one form of embodiment, the connector parts are screwed together by means of a male union nut.

BRIEF DESCRIPTION OF THE DRAWINGS

Forms of embodiment of the new connector are described in greater detail below, with reference to the following diagrams. In these diagrams.

Unless otherwise indicated, the diagrams use the same reference numbers for corresponding components.

DETAILED DESCRIPTION OF THE INVENTION

Figure 1:
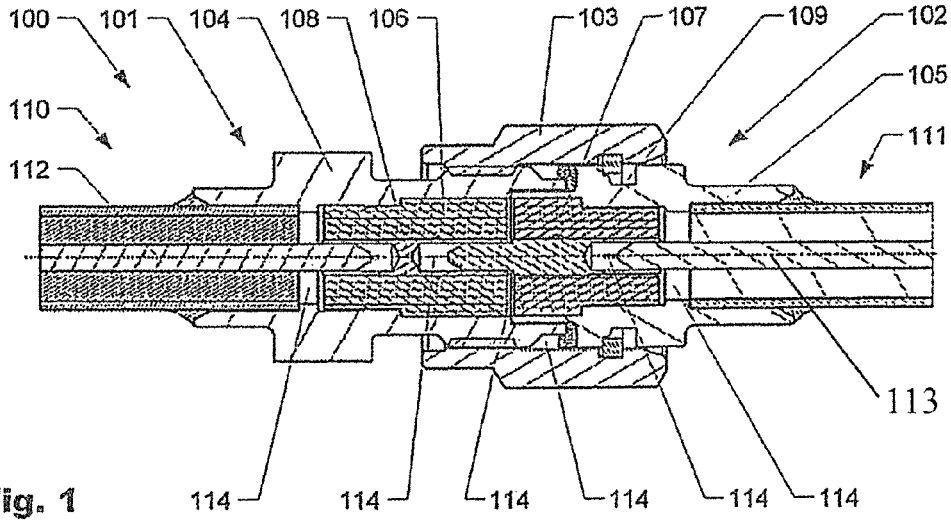
FIG. 1 shows a longitudinal section of a conventional SMA connector (prior art)

For the purposes of comparison, FIG. 1 shows a sectional view (longitudinal section) of a conventional SMA connector 100 (prior art). The connector 100 is provided with a female pan 101 and a male part 102, which are screwed together by means of a union nut 103. Viewed from the outside inwards, the female part 101 is provided with an exterior first housing 104, which encloses a first insulator 106. A first contact 108 is arranged in the first insulator 106, which on one side accommodates a first inner conductor 112 of a first cable 110. The male part 102 is provided with a second housing 105 for the accommodation of a second insulator 107 which encloses a second contact 109. On the outer side, the second contact 109 is used to accommodate a second inner conductor 113 of a second cable 111. In the operatively connected state (as represented), the second contact 109 is inserted into the first contact 108 which, in the region of the inner end, is configured in the form of a socket. It will be observed that, in the interior of the connector 100, a number of closed, comparatively large and radially oriented spaces and gaps 114 are present. The arrangement of the latter is such that no meaningful ventilation is possible. These spaces and gaps also have a detrimental impact upon the properties of the connector in space.

Figure 2:
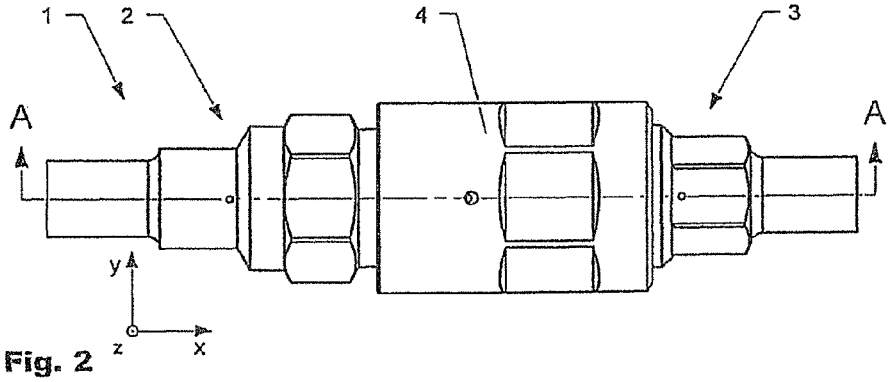
FIG. 2 shows an plan view of a PSM connector according to the invention.
Figure 3:
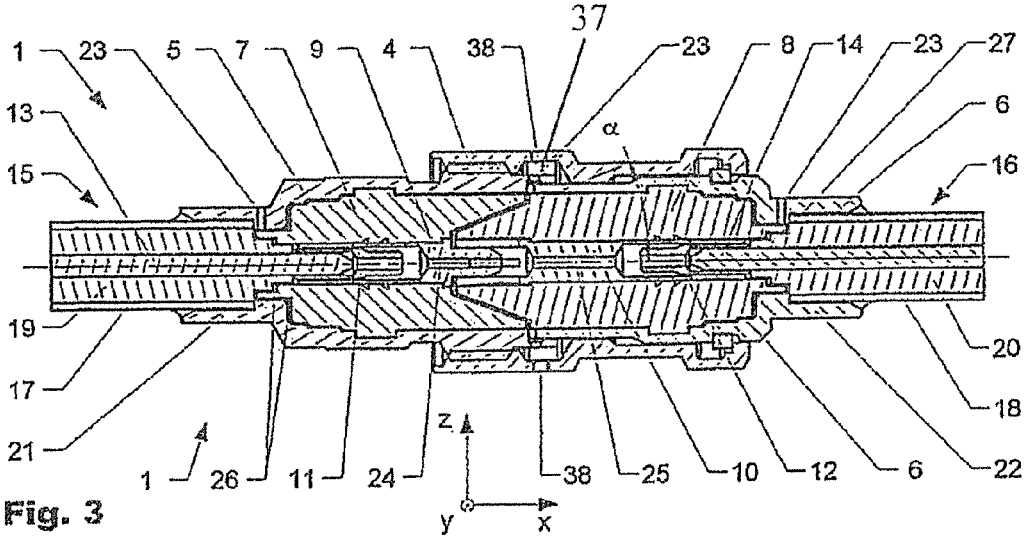
FIG. 3 shows a longitudinal section of the connector as shown in FIG. 2 along the section line AA.

FIG. 2 shows a plan view of a PSM connector 1 according to the invention. FIG. 3 shows a sectional view (longitudinal section) of the PSM connector 1 in accordance with FIG. 2 along the section line AA.

The coaxial connector (PSM connector) 1 according to the invention is provided with a female part 2 and a male part 3 which, in the operatively connected state (as represented) are screwed together by means of a union nut 4. The female part 2 is provided with a first housing 5, which serves as an outer conductor. A first insulator 7 is inserted into the first housing 5, from the front end. A first contact 9 is inserted into said insulator from the inside, which contact is supported here on the insulator 7 by means of a shoulder, and serves as an inner conductor for the transmission of signals. In the region of the rear end, the first contact 9 is configured such that, upon assembly, it can be mechanically connected to a first inner conductor 13 of a first cable 15. For the enhancement of the properties of the form of embodiment represented, a first ferrule 11 is used, which accommodates the inner conductor 13 at the rear end and, at the front end, is inserted into the first contact 9. The ferrule 11 improves the transmission of signals between the first inner conductor 13 and the male connector part 3.

Figure 4:
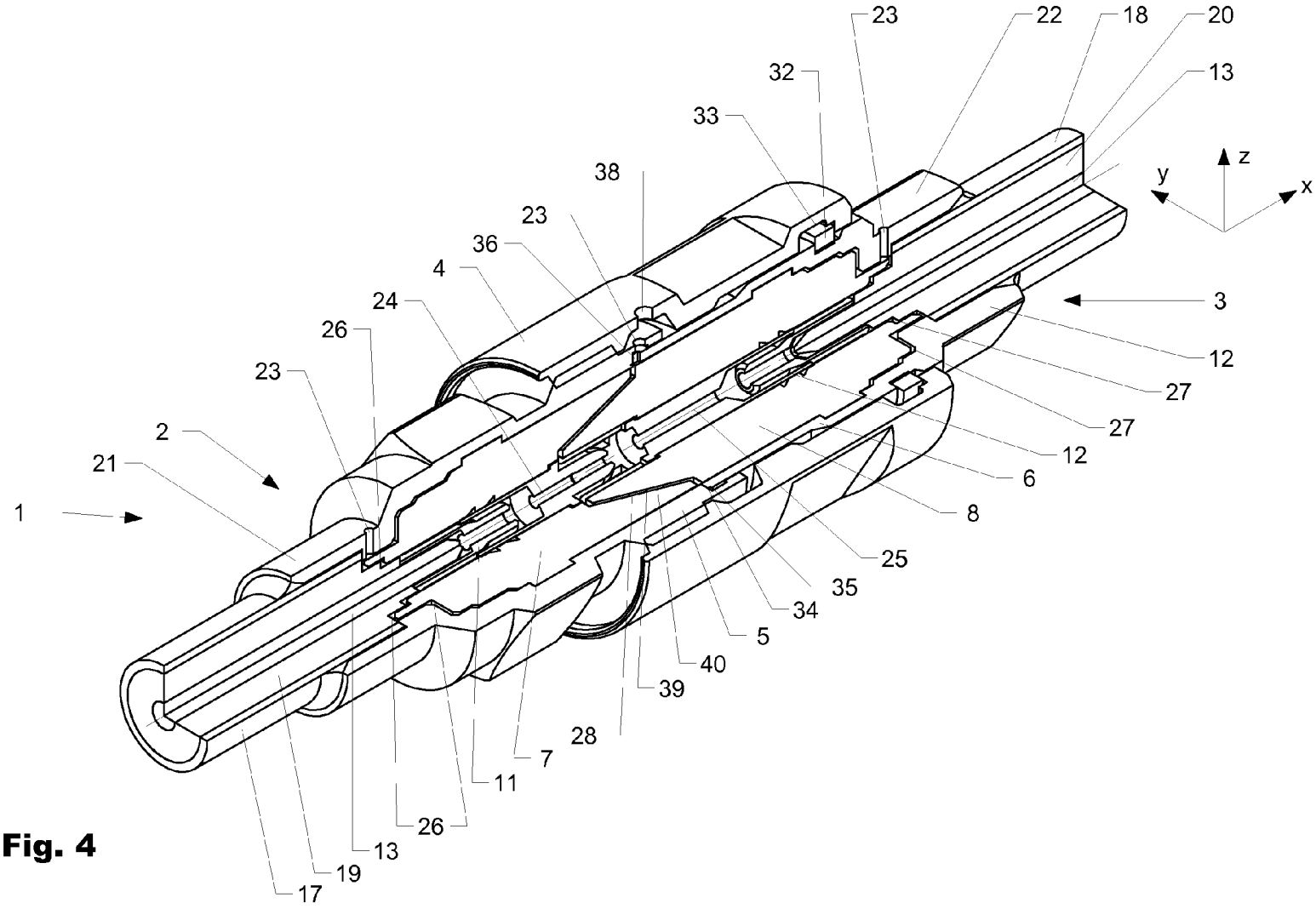
FIG. 4 shows an oblique sectional view of a connector according to the invention, viewed from the front and above with the connector parts in operatively connected state.

FIG. 4 shows the connector parts 2, 3 in the operatively connected state, viewed obliquely from above. A front section of the connector 1 is shown cut away through an angle of 90°, in order to provide a clearer view of the interior.

Viewed from the outside inwards, the male connector part 3 is provided with a second housing 6, which serves as an outer conductor. A second insulator 8 is inserted into the second housing 6 from the front side. The first and second insulators 7, 8 are generally formed of a plastic material, e.g. polytetrafluoroethylene or "PTFE", and are pressed into the housing 5, 6 of the connector parts 2, 3 from the front end, and secured accordingly. Other forms of attachment are possible. In the second insulator 8, a second contact 10 is pressed in from the front face. In the form of embodiment represented, the second contact 10 is configured at the front end in the form of a socket and is provided with spring tongues 29 (cf. FIG. 6) such that, in the operatively connected state, it cooperates with the first contact 9 of the female connector part 2, which is configured at its front end in the form of a pin and is provided with an internal recess. At the rear end, the second contact 10 is configured to permit the operative connection thereof to a second inner conductor 14 of a second cable 16. For the enhancement of the properties of the form of embodiment represented, a second ferrule 12 is used, which accommodates the second inner conductor 14 at the rear end and, at the front end, is inserted into the second contact 10. At their respective rear ends, the first and second housings 5, 6 of the connector parts 2, 3 are each provided with a flange 21, 22 for the connection of an outer conductor 17, 18 of the first and second cables 15, 16 respectively. The connection of the outer conductors 17, 18 to the flanges is generally provided in an electrically conductive and mechanically stable manner by soldering.

Figures 5, 6, 7, 8:
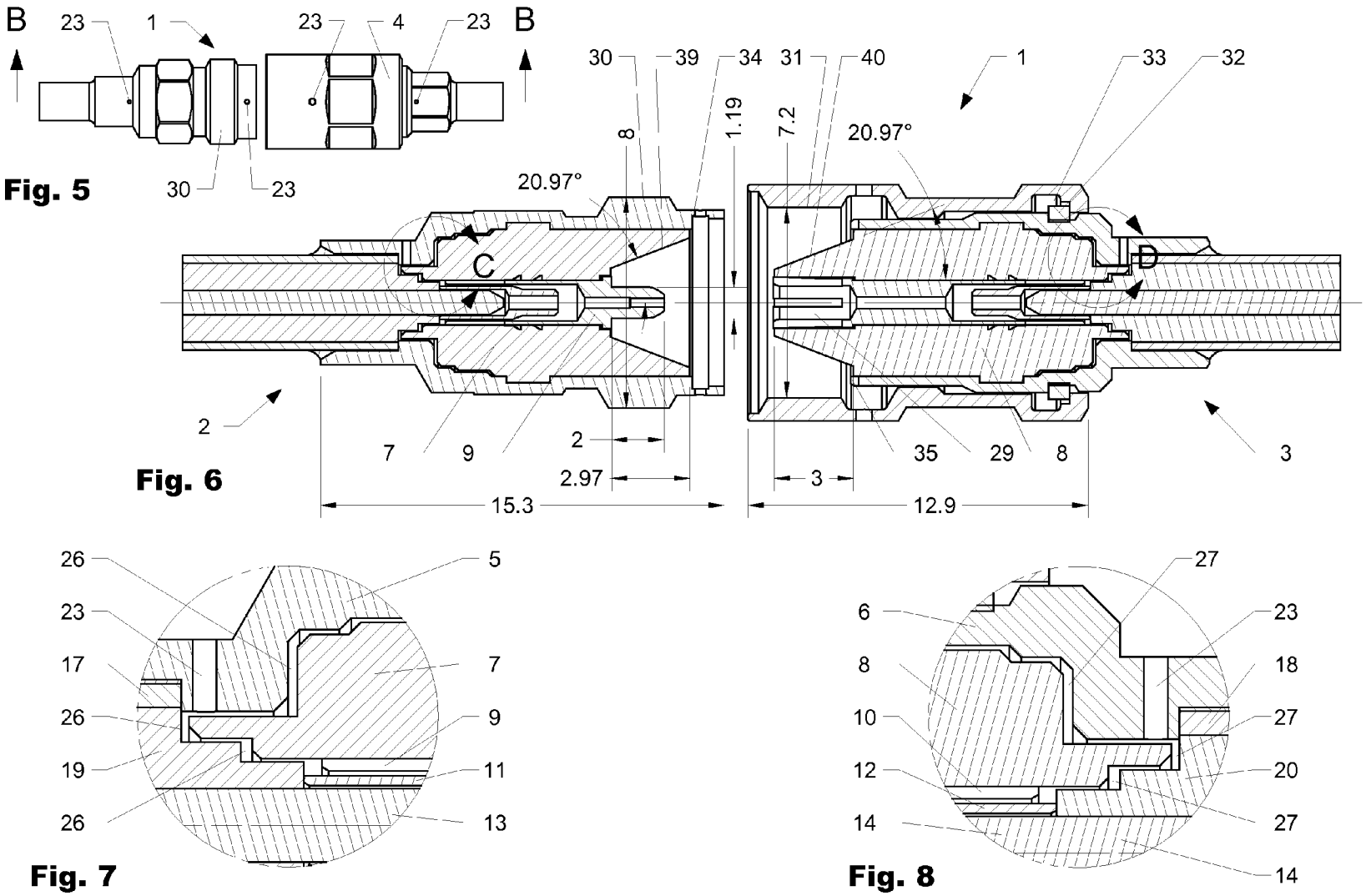
FIG. 5 shows a plan view of a connector according to the invention, with the connector parts not in operatively connected state.
FIG. 6 shows a longitudinal section of the connector as shown in FIG. 5 along the section line BB.
FIG. 7 shows detail C from FIG. 6.
FIG. 8 shows detail D from FIG. 6.

The housing 5 of the female part 2 is provided with an external threaded part 30, shown in FIG. 6 which, as represented in FIGS. 3 and 4, can be operatively connected to an internal threaded part 31 in the union nut 4 shown in FIG. 6. The union nut 4 is rotatable in relation to the housing 6 of the male part 3, and is arranged for displacement in the axial direction (x-direction). A circlip 32 arranged on the male housing 6 engages in an internal groove 33 in the union nut 4, thereby restricting the axial displacement of the union nut 4 in relation to the male housing 6. In the operatively connected state (cf. FIGS. 3 and 4), the housings 5, 6 of the connector parts 2, 3 are compressed together at their front faces by means of the union nut 4 along a first and second annular contact surface 34, 35. At least one of the contact surfaces is provided with a groove 36, which permits ventilation via the third ventilation channel 28. The union nut 4 is provided with an internal annular ventilation channel 37 which, in this case, discharges into two diametrically opposing ventilation openings 38, extending outwardly in the radial direction. The function of the ventilation openings 38 is the ventilation of the third ventilation channel 28 and the interior of the union nut 4.

The internal connector parts for the conduction of signals are preferably gold-plated. By means of the likewise gold-plated ferrules 11, 12, optimum contact in the interior of the connector 1 can be ensured. The ferrules 11, 12 are generally secured to the inner conductors 13, 14 of the cables 15, 16 by soldering.

FIG. 6 shows a PSM connector 1 according to the invention, which is comprised of a female first connector part and a male second connector part 2, 3. The PSM connector 1 is of essentially the same dimensions as a conventional SMA connector from the prior art. A number of key dimensions of this form of embodiment are indicated on the diagram by double arrows (unit of measurement: mm). One of the key differences between connectors known from the prior art and the PSM connector 1 represented here is the deliberate avoidance of detrimental air gaps. In the design according to the invention, where gaps are essential, they are arranged for the achievement of optimum transmission capability.

As shown in FIGS. 3, 4 and 6, and in the details C and D represented in FIGS. 7 and 8, the first and second contacts 9, 10 are each provided with a longitudinal ventilation channel 24, 25. At their respective rear ends, these discharge into a labyrinthine and outwardly extending first and second ventilation channel 26, 27 respectively. The outwardly extending ventilation channels 26, 27, configured in the form of gaps, extend outwardly in a step-wise arrangement comprised of a number of stages, and discharge at their outer end into ventilation openings 23. These channels are formed by the correspondingly recessed insulators 19, 20 of the cables 15, 16 and the insulators 7, 8 of the connectors 2, 3 in the housings 5, 6 respectively.

In the operatively connected state (cf. FIGS. 3 and 4), the insulators 7, 8 of the connector parts 2, 3 form a third ventilation channel 28, configured in the form of a gap and which, viewed in longitudinal section, extends outwardly essentially diagonally, i.e. at an angle $\alpha$ to the longitudinal connector axis (x-axis), and discharges into ventilation opening 23 at the outer end. The third ventilation channel 28 is also mechanically connected to the longitudinal ventilation channels 24, 25. In the example shown in FIG. 6, the angle $\alpha$ of the ventilation channel is approximately 21°. The third ventilation channel 28 is formed by two conical end surfaces 39, 40 of the first and second insulators 7, 8 of the connector parts 2, 3. The end surfaces 39, 40 are configured to form an annular third ventilation channel 28 of constant thickness. The dimensions indicated may be varied within a certain range of tolerance, provided that there is no resulting adverse effect upon the mode of operation.

The invention claimed is:

1. A coaxial connector (1) with a female and a male connector part (2, 3), the coaxial connector (1) comprising:

an internal ventilation channel (24, 25) provided in the interior of a contact of each of the female and male connector parts (2, 3) which extends in the longitudinal direction (x) of the respective connector part (2, 3) and which discharges into at least one outwardly extending ventilation channel (26, 27), which is stepped when viewed in longitudinal section, the at least one outwardly extending ventilation channel (26, 27) discharging in a ventilation opening in the connector.

2. The coaxial connector (1) as claimed in claim 1, wherein both the female and the male connector parts (2, 3) are provided with an outwardly extending ventilation channel (26, 27).

3. The coaxial connector (1) as claimed in claim 1, wherein the at least one outwardly extending ventilation channel (26, 27) is formed between a respective insulator (7, 8) of a connector part (2, 3) and a respective insulator (19, 20) of a cable (15, 16).

4. The coaxial connector (1) as claimed in claim 1, wherein in a signal transmitting operatively connected state of the female connector part with the male connector part, an essentially diagonal ventilation channel (28), viewed in longitudinal section, is arranged between the female and the male connector parts (2, 3).

5. The coaxial connector (1) as claimed in claim 4, wherein the diagonal ventilation channel (28) is formed by the insulators (7, 8) of the female and the male connector parts (2, 3).

6. The coaxial connector (0) as claimed in claim 5, wherein the essentially diagonal ventilation channel (28) is configured with a rotationally symmetrical form.

7. The coaxial connector (1) as claimed in claim 4, wherein the female and the male connector parts (2, 3) can be screwed together by means of a nut (4) and the essentially diagonal ventilation channel (28) discharges through a ventilation opening (38) in the nut (4).

8. The coaxial connector (1) as claimed in claim 1, wherein the at least one outwardly extending ventilation channel (26, 27) is configured with a rotationally symmetrical form.

9. The coaxial connector (1) as claimed in claim 1, wherein the female and the male connector parts (2, 3) can be screwed together by means of a male union nut (4).

* * * * *